US006623366B2

(12) United States Patent
Fiedler

(10) Patent No.: US 6,623,366 B2
(45) Date of Patent: Sep. 23, 2003

(54) MAGIC TRICK WITH VANISHING EFFECT

(75) Inventor: Lubor Fiedler, Spital/Drau (AT)

(73) Assignee: Mark Setteducati, New York, NY (US)

( * ) Notice: Subject to any disclaimer, the term of this patent is extended or adjusted under 35 U.S.C. 154(b) by 0 days.

(21) Appl. No.: 10/085,438

(22) Filed: Feb. 26, 2002

(65) Prior Publication Data

US 2003/0054894 A1 Mar. 20, 2003

Related U.S. Application Data

(60) Provisional application No. 60/272,252, filed on Feb. 28, 2001.

(51) Int. Cl.[7] ..... A63G 31/00
(52) U.S. Cl. ..... 472/71; 472/63; 472/81
(58) Field of Search ..... 472/71, 72, 74, 472/77, 79, 81, 63; 40/427, 436, 437

(56) References Cited

U.S. PATENT DOCUMENTS

| | | | | | |
|---|---|---|---|---|---|
| 715,730 | A | * | 12/1902 | Zinn | 472/75 |
| 720,820 | A | * | 2/1903 | Kraus | 40/427 |
| 1,099,852 | A | * | 6/1914 | Kieley | 472/77 |
| 1,475,430 | A | * | 11/1923 | Curwen | 352/81 |
| 1,619,719 | A | * | 3/1927 | Goldman et al. | 446/82 |
| 1,888,320 | A | * | 11/1932 | Hudiakoff | 40/488 |
| 4,233,767 | A | * | 11/1980 | Hryhorczuk | 40/437 |
| 4,428,575 | A | * | 1/1984 | Kerr | 472/74 |
| 5,924,870 | A | * | 7/1999 | Brosh et al. | 40/436 |

FOREIGN PATENT DOCUMENTS

| | | |
|---|---|---|
| EP | 0323108 | 7/1989 |
| EP | 0648162 | 11/1999 |

* cited by examiner

*Primary Examiner*—Kien T. Nguyen
(74) *Attorney, Agent, or Firm*—Robert W. J. Usher

(57) ABSTRACT

A magic trick in which one of two perpendicularly extending subjects vanishes behind a lenticular screen while the other subject remains visible and extends over aligned locations formerly occupied by portions of the one subject. The screen has parallel lenticules. One subject is an upright human figure, living creature or other vertically extending article, printed or live, and adjacent the second subject which is a series of printed horizontal parallel stripes or solid bars/wires forming a background for the first subject. The subjects can form scenery on a stage or be on the inside back cover of a book with the screen mounted across the front.

41 Claims, 9 Drawing Sheets

FIG. 1A
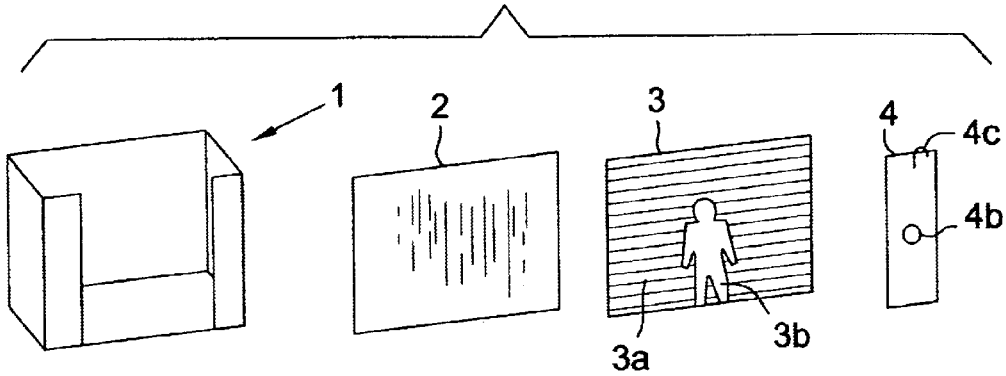
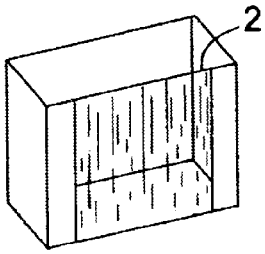
FIG. 1B
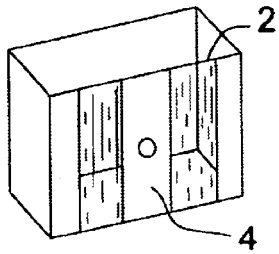
FIG. 1C
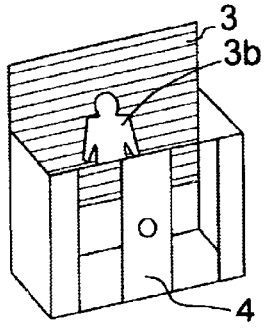
FIG. 1D
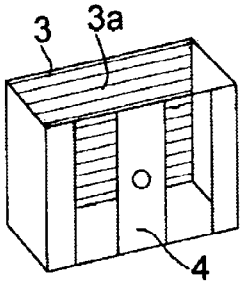
FIG. 1E
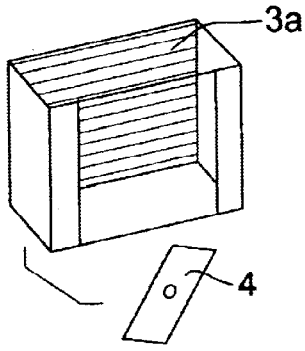
FIG. 1F
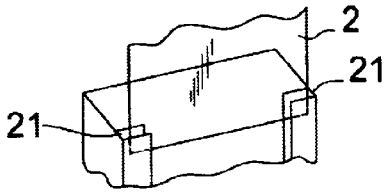
FIG. 1G FIG. 4A
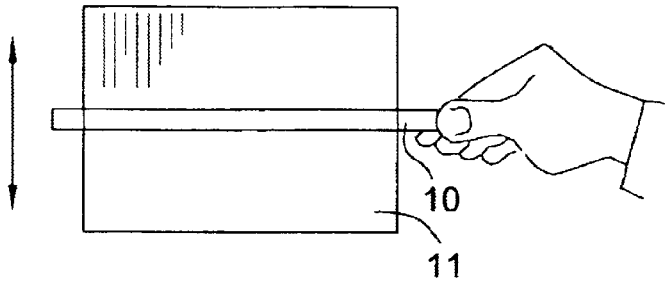
FIG. 4B
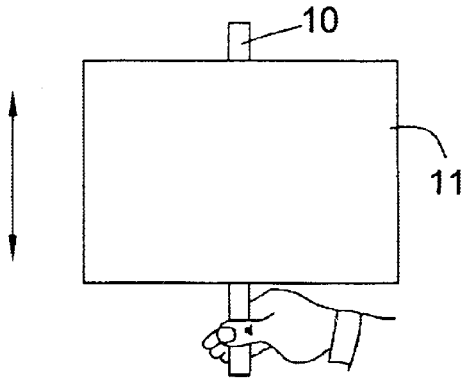
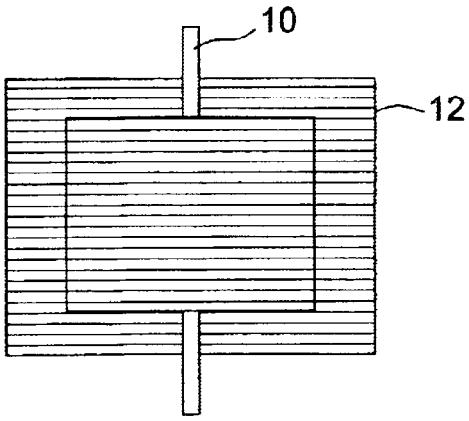
FIG. 4C
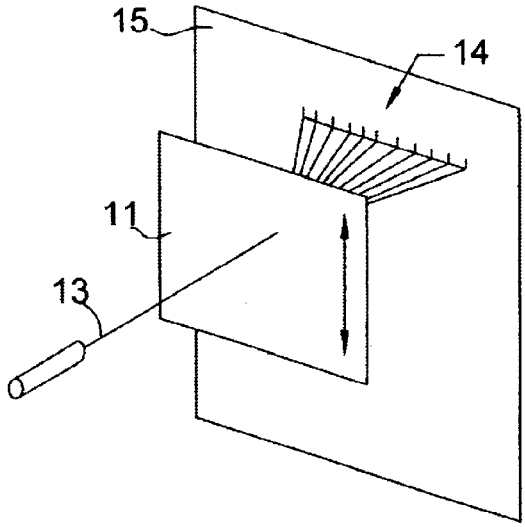
FIG. 5

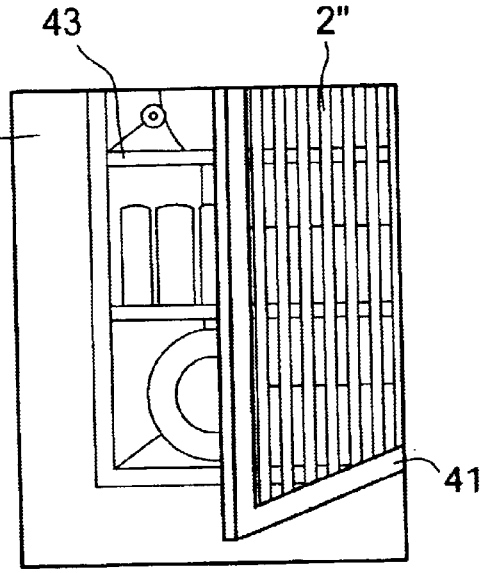
FIG. 11
FIG. 12
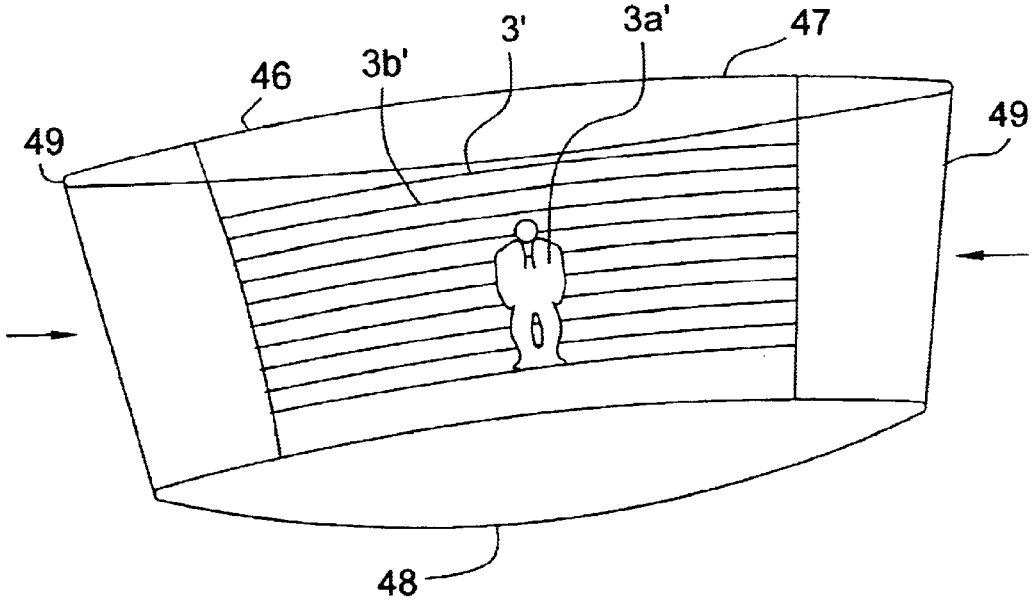

MAGIC TRICK WITH VANISHING EFFECT

RELATED APPLICATIONS

Provisional application Ser No. 60/272,252 filed Feb. 28, 2001 from which priority is hereby claimed now abandoned.

FIELD OF THE INVENTION

The invention relates to a magic trick in which one part of a scene is caused to disappear or to be invisible while another part remains visible and essentially unchanged.

BACKGROUND OF THE INVENTION

It is known to conceal printed information by laminating lenticular screens, composed of transparent sheets formed with series of parallel adjacent lenticules with printed sheets or I.D. cards to preventing exact copies of the information being made by conventional office photocopying techniques, has been known for many years. It is also prior art to prevent legible photocopying by providing opaque lines or striae along central longitudinal axes of respective individual lenticules of the screen which are magnified or spread by the lenses so that the information is completely masked or blanked out unless the laminated sheet is viewed obliquely. It is also well known, for example on I.D. cards, postcards or greeting cards, to laminate lenticular screens on pictures composed of alternately different image elements only selectively visible through the lenticular screen when viewed at different angles to provide different images, images of a same scene from different angles, or motion picture effects.

However, none of the prior approaches are suited for the purpose of the present invention.

SUMMARY OF THE INVENTION

An object of the invention is to provide a magic trick in which a first part of a scene is caused to disappear or to be invisible while a second part remains visible and unchanged except where it appears to extend over and replace portions of the first part of the scene.

According to one aspect, the invention includes the steps of providing a scene comprising first and second subjects extending in mutually perpendicular directions; providing a lenticular screen having a series of parallel lenticules; and, relatively positioning the lenticular screen and the scene with the lenticular screen extending a predetermined distance spaced apart from and in front of the scene and with the lenticules extending in a same direction as the direction of extension of the first subject so that when an audience observes the scene through the lenticular screen, the first subject is invisible while the second subject (extending perpendicular to the direction of extension of the lenticules) remains visible. The second subject appears unchanged except where it extends over locations fromerly occupied by the first subject.

In one embodiment of the invention, the second subject comprises a series of printed horizontal parallel stripes or solid bars/wires forming a background for the first subject which comprise a upright human figure, living creature or other vertically extending article printed or live, adjacent the second subject and, preferably, in the foreground.

Apparatus according to the invention comprises a stage, a lenticular screen with a series of parallel lenticules extending in a common direction mountable across a front of the stage and a screen marked with first and second subjects having major axes extending in mutually perpendicular directions and positionable extending across the stage spaced apart behind the lenticular screen with the major axis of the first subject extending in a same direction as the extension direction of the lenticules so that when an audience observes the scene through the lenticular screen, the first subject is invisible while the second subject (extending perpendicular to the direction of extension of the lenticules) remains visible.

In one version of the invention, a standing figure of a toy soldier is placed in front of a surface printed with horizontal striped stripes. When a person looks at this scene they see a soldier standing in front of background of striped stripes. The portions of striped stripes behind the soldier are blocked from view by the soldier. When the same scene is viewed looking through a lenticular screen with the lenticules in a vertical position and the lens at the right distance, the person viewing this scene cannot see the soldier, and the portion of the horizontal stripes of the background that were blocked from view by the soldier now seem to be visible, so the person looking at this scene sees the entire background of horizontal striped stripes creating the illusion that the soldier has completely disappeared i.e absent!

This same illusion is created even if the soldier is a printed image of a soldier on a printed background of horizontal stripes. The printed image of the soldier appears to disappear and the horizontal background stripes remain, including the illusion of horizontal stripes in the area formerly occupied by the printed image of the soldier.

BRIEF DESCRIPTION OF THE DRAWINGS

FIGS. 1*a*–1*g* are schematic perspective views showing sequential steps in the performance of a magic trick in which a subject in the foreground of a screen or picture disappears or becomes invisible while the background remains visible;

FIGS. 4*a,* 4*b* and 4*c* are schematic views showing the variations in the appearance of a rod when positioned extending in different directions at a suitable distance behind a lenticular screen, a striped background sheet being added in FIG. 4*c;*

FIG. 5 is a schematic perspective view showing that a laser pointer beam incident as a point on a lenticular screen is spread by the lenticules to form a stripe on a screen;

FIG. 11 is a schematic front view of a kitchen cabinet according to the invention, with the door ajar according to the invention; and FIG. 12 is a schematic perspective view of an apparatus for bringing a subject image into and out of sight.

DESCRIPTION OF PARTICULAR EMBODIMENTS

As shown in FIG. 1*a,* the trick props comprise a miniature, box-form stage 1, a lenticular lens screen or 'curtain' 2, a picture 3 and a 'door' 4.

The miniature, box-form stage 1, has a rear, bottom and opposite side walls with wing portions extending inward from respective side walls at a front, so that the stage is open at a top and at the front.

Figure 2:
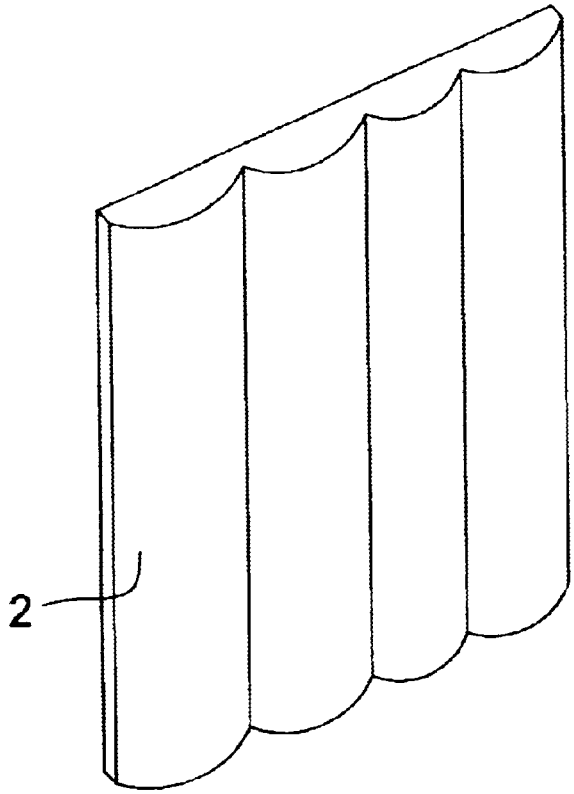
FIG. 2 is a schematic perspective view of a portion of a lenticular lens used in the invention.

The lenticular screen 2, more clearly seen in FIG. 2 is of well known type being formed by a series of hemicylindrical lenticules or lens elements extending side by side with parallel longitudinal axes and optical axes perpendicular to the plane of the sheet d.

Figure 3A:
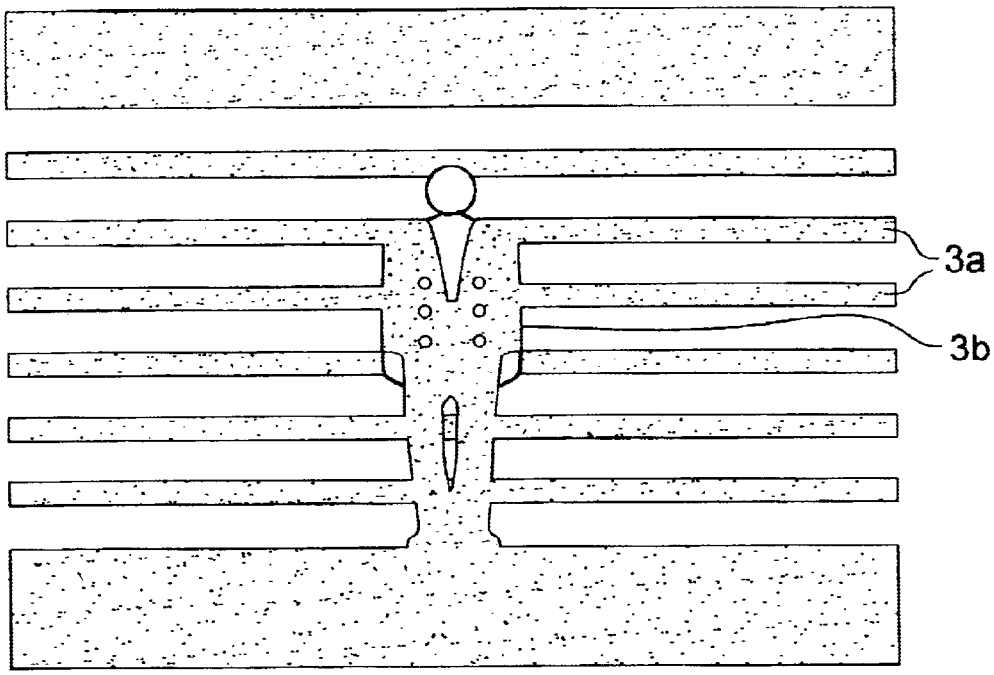
FIGS. 3*a* and 3*b* are schematic views of the picture as seen by the naked eye and as seen through a suitably positioned lenticular screen.
Figure 3B:
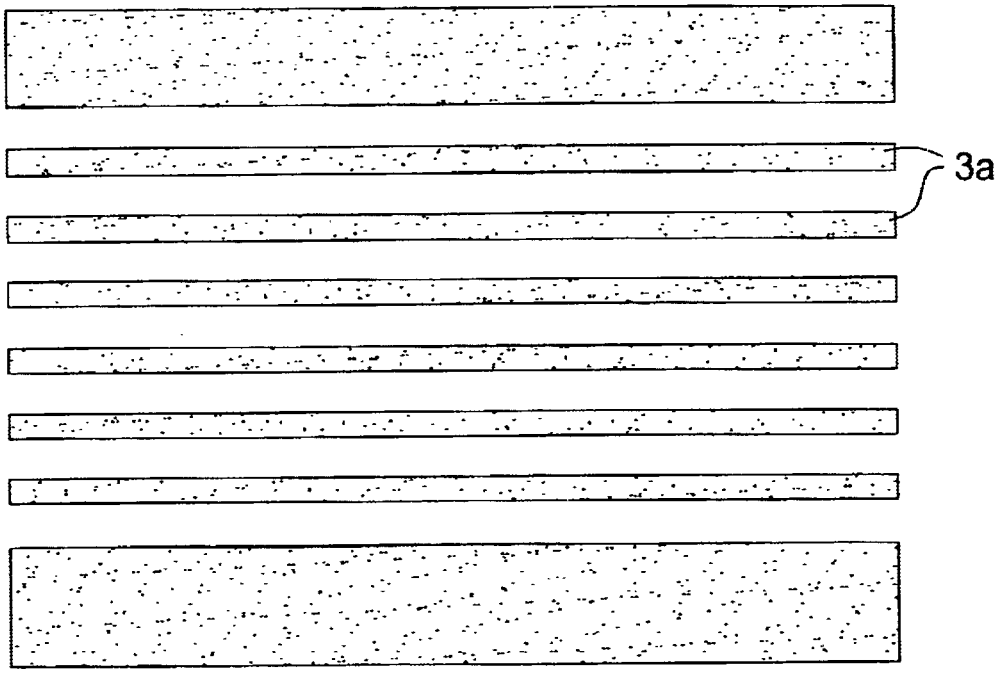
Figure 7A:
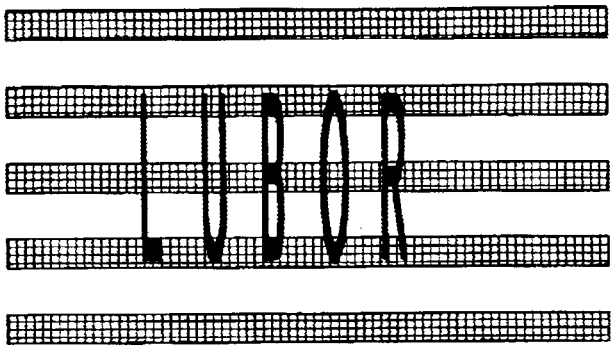
FIGS. 7*a*–7*d* are diagrams of the name LUBOR overprinted on horizontal stripes of respectively different colors.
Figure 7B:
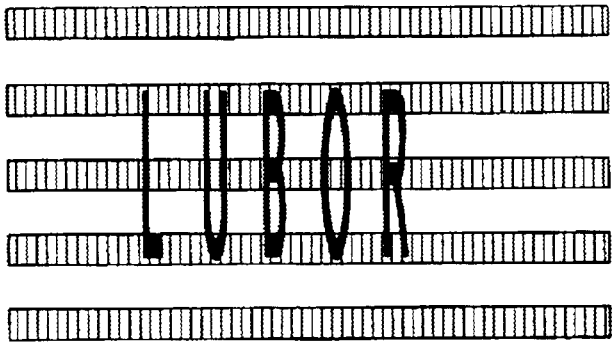
Figure 7C:
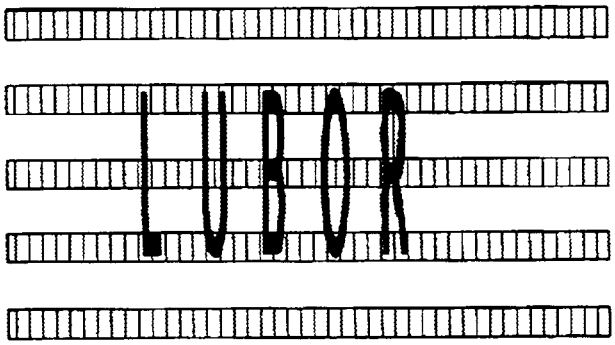
Figure 7D:
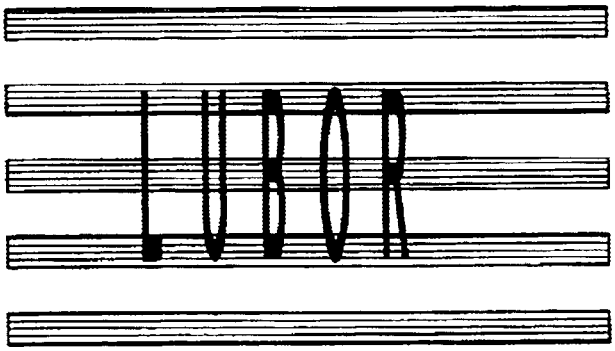

The picture 3, more clearly shown in FIG. 3*a,* is composed of a background subject formed by a series of parallel black stripes 3*a* extending horizontally in relation to a foreground subject formed by a central stylized FIG. 3*b* of a standing person having white portions overlying the black stripes to emphasize the positional relationship of the FIG. 3*b* and the stripes 3*a.*

The 'door' 4 comprises a rectangular strip of opaque, rigid material carrying a lamp 4*b* and having a mounting clip 4*c* or similar fastening device on an upper edge.

The trick routine commences by the magician initially showing all of the props to the audience to demonstrate that nothing out of the ordinary is concealed. The magician then insets the lenticular screen 3 into the 'stage' to extend across the front, spanning the wings with the lenticules extending vertically, as shown in FIG. 1*b,* and clips the 'door' centrally onto the front of the screen, as shown in FIG. 1*c.*

The magician then inserts the picture into the box-form stage along the rear wall, as shown in FIG. 1*e.* As the door 4 is positioned directly in front of the standing FIG. 3*b,* the audience initially believe that the figure is hidden behind the door, particularly as they can clearly see the horizontal stripes, as shown in FIG. 1*f.* The light from the lamp makes it more difficult for the audience to see the rear of the stage clearly during insertion of the picture adding a sense of mystery and, possibly, an element of confusion.

The magician then removes the door and the audience is astonished to find that only the horizontal stripes are visible, the figure has disappeared. Furthermore, the stripes appear to extend over aligned locations formerly occupied by the figure.

In another version shown in FIG. 1*g,* the wings forming the front of the box or stage are of vertical channel section 21 for sliding receipt of opposite edges of the screen so that an object or subject image positioned in front of or on the striped background can be made to progressively disappear and reappear by sliding the screen along the channels progressively interposing the screen between the object/image and audience and withdrawing the screen progressively revealing the object or subject image while the back ground stripes remain visible all the time.

The stripes need not be continuous stripes. Broken stripes will still be visible provided they extend perpendicularly to the longitudinal axes of the lenticules but preferably are contiunuos so that the background remains the same appearance when viewed either directly or through the lens. The pitch or density of the lenticules may be selected according to the size of the foreground object distance of the screen from the object, increasing with size and screen distance.

In one example, the pitch or density of the lenticules is 75 per inch; the screen is located 2.5–3 inches from the picture (corresponding to the front to rear depth of the stage); the stripes or lines are approximately 3/16 wide and approximately 3/16 inches apart; the figure is 2 inches high with a maximum width of 3/16 inch.

In another embodiment, a live person standing in front of a horizontally striped background and spaced apart from a suitable lenticular screen can be made invisible while the back ground remains visible. In such case, a suitable screen has 15 lenticules per inch and is spaced 2–3 ft in front of the person.

In general, either a background subject or a foreground subject can be made invisible according to which extends parallel to the lenticular axis.

In one embodiment the stripes are formed by parallel light beams, for example, laser generated.

The stage prop may be replaced by a book-form housing with the front leaf or cover forming the equivalent of a curtain. The picture is placed on the inside of the back cover and the lenticular screen located in the book spaced apart, a predetermined distance in front of the back cover.

The stage prop can be a box into which a body part such as ahead or arm may be inserted so as to disappear behind the lenticular screen mounted as a window on a front of the box while the remainder of the body remains visible to an audience.

The pitch or density of the lenticules or lense elements may be varied. The larger the disappearing subject, the larger the lenticules.

As seen in FIG. 4*a,* when the middle of a rod 10 is positioned spaced apart at a suitable distance (e.g a few centimeters) behind a lenticular screen 11 in which the rod axis extends perpendicularly to the lenticules, the entire rod is visible while, as shown in FIG. 4*b,* when the rod extends parallel to the lenticules, the middle of the rod is invisible.

However, as shown in FIG. 4*c,* a background screen 12 marked with stripes extending perpendicularly to the lenticules remains visible, increasing the mystery of the disappearance of the middle portion of the rod.

As shown in FIG. 5, a laser pointer beam 13 incident as a point on a lenticular screen 11 is spread by the lenticules to form a stripe 14 on a screen 15. Similarly a black dot positioned centrally behind the lenticular screen is spread into many image fragments too indistinct to be seen by the naked eye.

Figure 6:
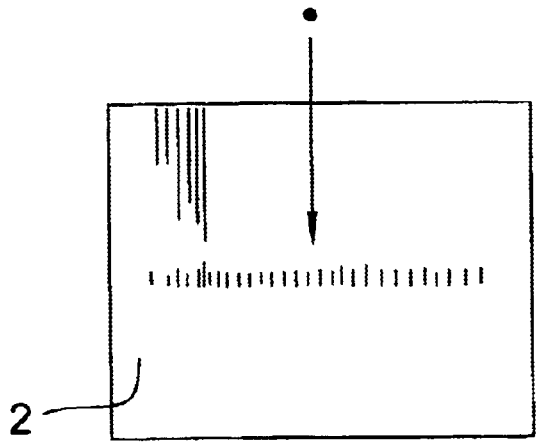
FIG. 6 is a schematic showing the spread of the image of a dot

FIG. 6 shows the spread of the image of a dot positioned behind the lenticular screen illustrating the principle underlying the operation of the lenticular lense.

The dominance resulting from the cumulative image spreading effect in the direction perpendicular to the lenticules may be seen in FIGS. 7*a*–7*d* where the name LUBOR is printed in black ink on backgrounds of horizontal stripes which are yellow, mauve/pink, red and light blue in color, respectively. Although discrete horizontal portions of the letters overlie and obscure portions of the stripes so that they are clearly visible to the naked eye, in all cases, even with the much lighter yellow and blue, the black image portions are completely obscured by the colored stripes, (so as to be invisible), when viewed through a lenticular screen spaced at a correct distance therefrom with lenticules extending perpendicular to the stripes.

Figure 8:
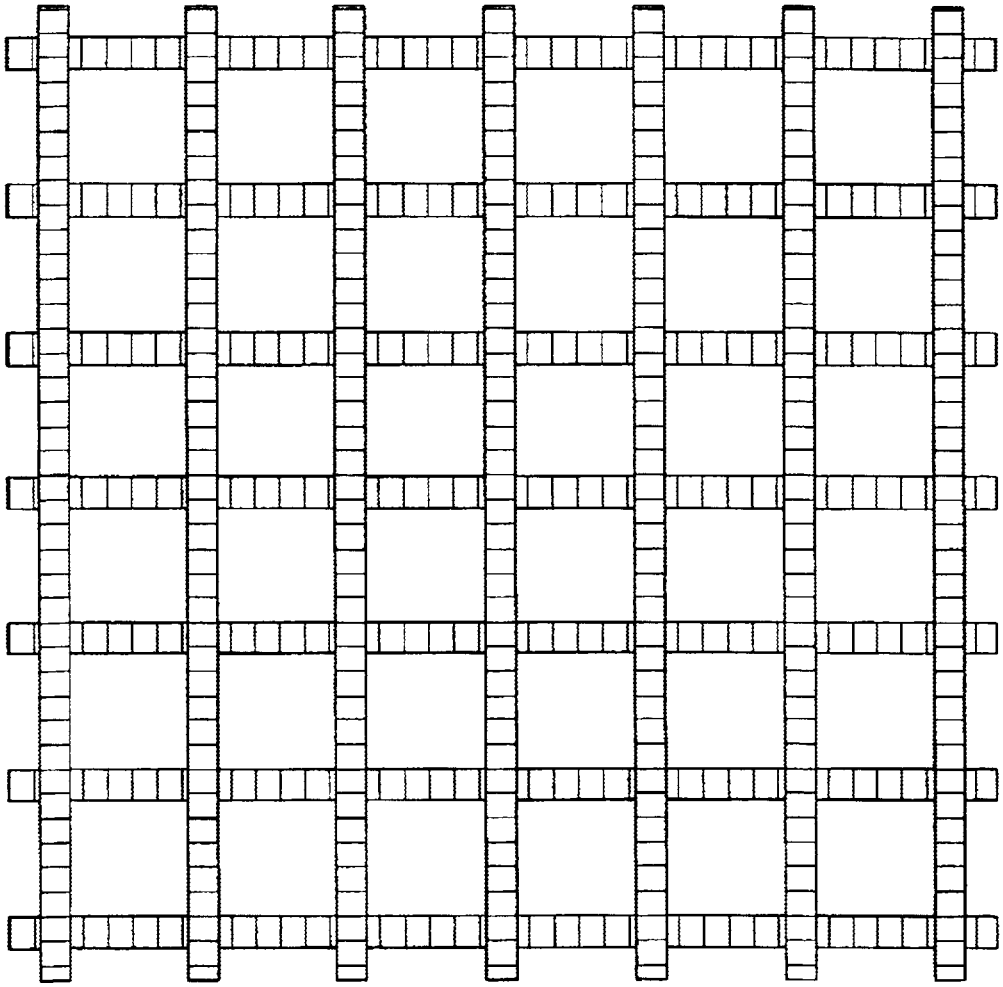
FIG. 8 is a diagram of a series of parallel blue stripes overlying a perpendicular series of parallel red stripes.

Similarly, even where a series of parallel blue stripes are printed over a perpendicularly extending series of parallel red stripes, as shown in FIG. 8, and clearly visible as unbroken blue stripes to the naked eye while the red strips are broken by the overlying portions of the blue stripes, when viewed through a lenticular screen in which the lenticules extend parallel to the blue stripes, the blue stripes disappear completely and the red stripes appear unbroken or continuous even at locations where they are covered by the blue stripes. When the screen is rotated in a plane parallel to the plane of the stripes, continuous blue and continuous red stripes appear and disappear, alternately. The screen can be mounted for such rotation by any suitable mechanical means, for example, pin-wheel fashion.

Figure 9B:
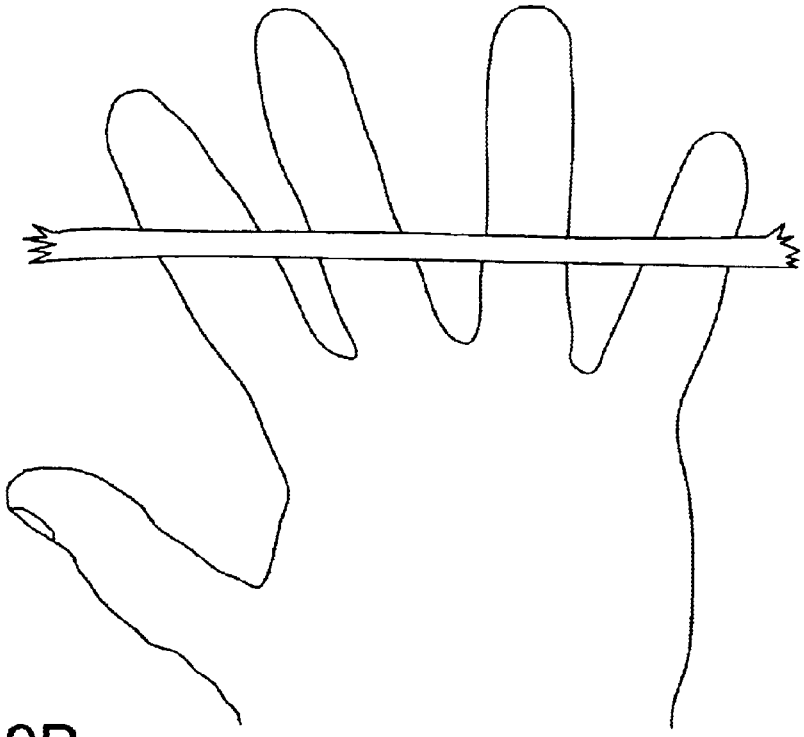
FIGS. 9*a* and 9*b* are schematic views illustrating a spectator's hand supporting a knotted rope and the same rope appearing "unknotted" when viewed through a lenticular screen having lenticules extending perpendicularly to the longitudinal direction of the rope, respectively.
Figure 9A:
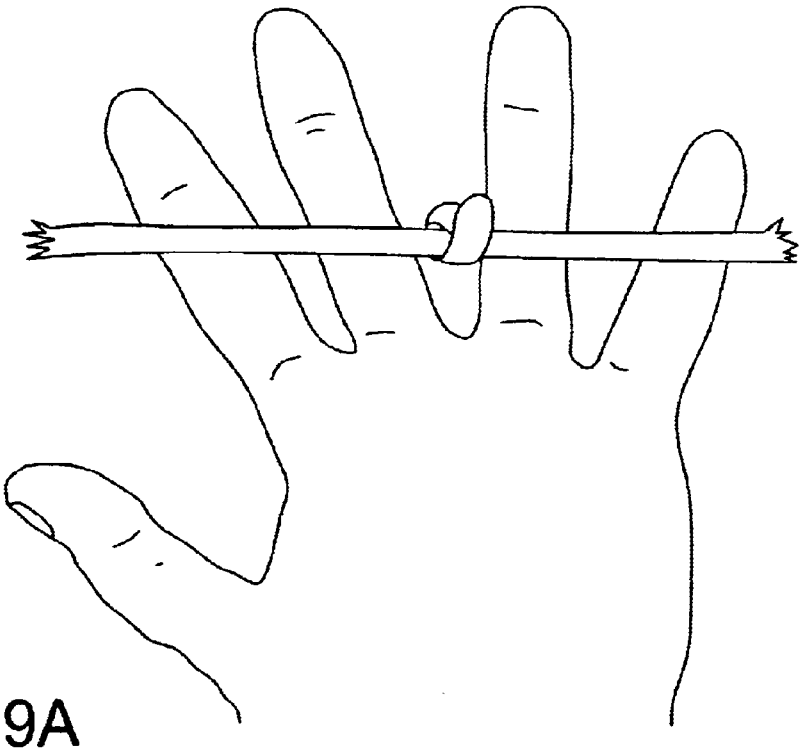

As shown in FIGS. 9*a* and 9*b,* a knot in a rope disappears when a portion of the rope in the vicinity of the knot is viewed through a small lenticular screen having lenticles extending perpendicularly to the longitudinal direction of the rope, respectively. (In practice, the magician's fingers may appear somewhat blurred).

In a trick, the magician places the knotted rope on a spectator's hand while concealing the knot by covering it with his fingers while simultaneously also holding the screen spaced above and covering the knotted portion and removing his hand so that the rope appears to the spectator to be normal straight and unknotted as the knot is not visible to the spectator behind the screen. The magician then announces that he will make a portion of the rope disappear and turns the screen through 90 degrees so that the lenticules are parallel to the rope and the rope disappears under the screen the magician then rotates the screen back to the original position to reveal again the straight rope, then slowly lowers the screen so that the knot to gradually reveal the knot providing the illusion that the rope has magically been tied. The magician removes the screen to reveal the knotted rope. Although the spectator's fingers may appear somewhat blurred his attention will have been focussed throughout the trick on the rope, under the direction of the magician.

Basically, markings perpendicular to the lenticules are spread or extended by fragmentation in the perpendicular direction while markings extending in the same direction as the lenticles are obscured. As a result of the image spreading effect, gaps in objects extending perpendicularly to the lenticules can disappear when view through the lenticular screen, filled by the spread image portions of the object on respective opposite edges of the gap.

The effect of making a broken object whole can be obtained as a transverse break/gap in an elongate object(s) can be filled when viewed through a lenticular lens with the lenticules perpendicular to the object, as a result of the spread image of portions of the object on each side of the break/gap extending over and obscuring the gap.

The gap should extend perpendicular to the lenticules when the object(s) cover a wider area as with a gap extending between two adjacent sheets of paper.

Elongate objects (printed or solid) behind the screen can be made to appear and disappear by altering the relative separation the object and screen.

In another embodiment of the invention, an electronic display screen provides a background formed by parallel stripes and with a subject image extending perpendicularly across the parallel stripes; and a screen with parallel lenticules is positioned parallel and in front of the electronic display screen, with the lenticules extending perpendicular to the background stripes and in the same direction as the image. The separation of the lenticular screen from the surface of the electronic screen is varied so that when the electronic display screen is viewed through the lenticular screen, the subject image progressively one of appears and disappears. An another version the subject image on the electronic screen is changed or moved.

A framed version of a lenticular screen can be sold as a premium as a magic window with instructions to visit a magic web site, newspaper or shop and use the lenticular screen in the above manner.

Figure 10:
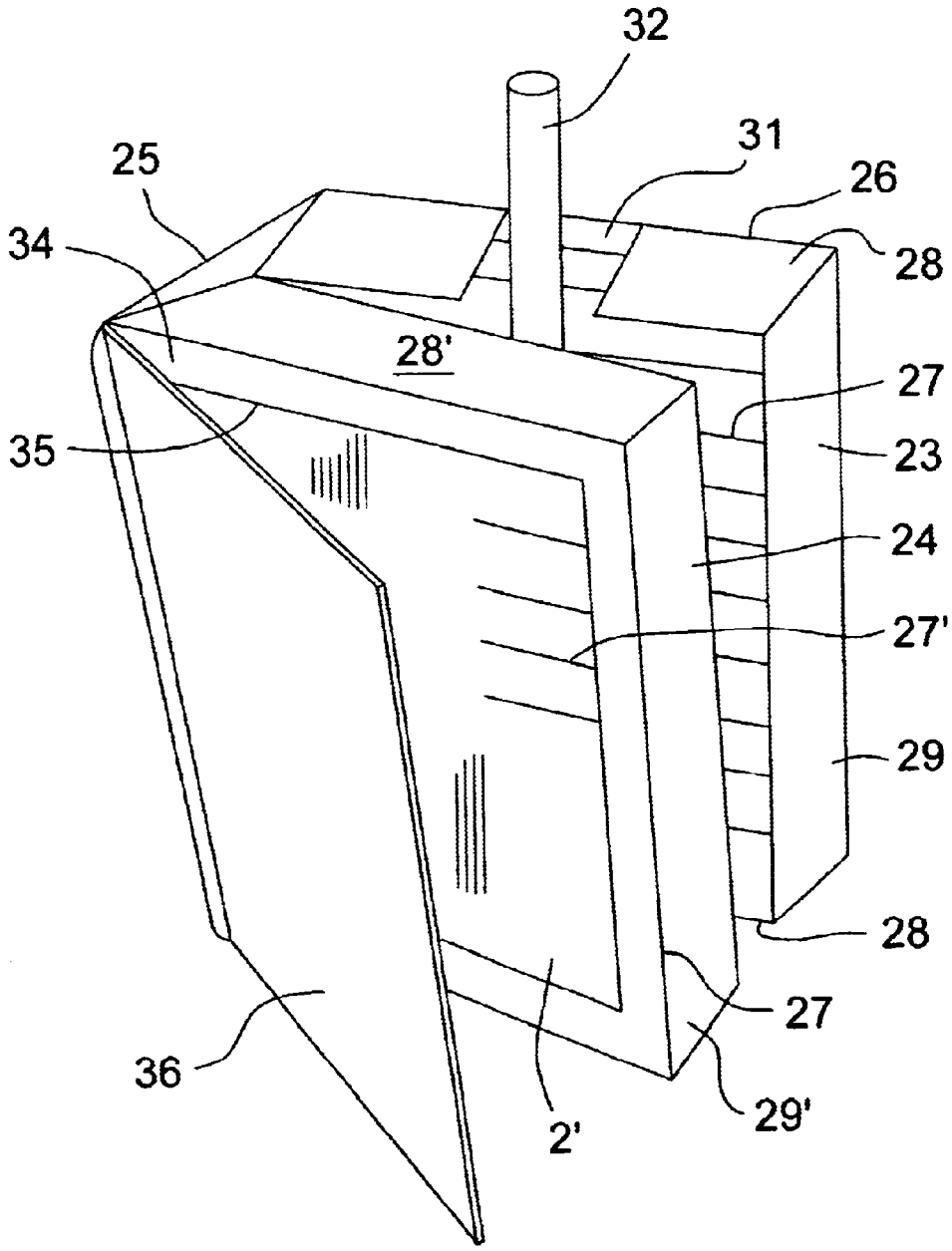
FIG. 10 is a schematic perspective view of a book according to the invention.

The hollow book structure shown in FIG. 10 comprises back and front half shells 23 and 24, respectively, hingedly joined along adjacent edges by a spine 25. The back half shell 23 has a back wall or cover portion 26 having an inside surface marked with parallel stripes 27 and outstanding end walls 28 joined by a side wall 29, with the spine closing an opposite side. Aligned cut-outs 31 are in opposite end walls for admitting an elongate object such as a pencil 32 extending completely through the book, perpendicularly of the stripes 27. The front half shell also has end walls 28' joined by a side wall 29' and a front wall or sheet 34 formed with a window 35 across which a lenticular screen 2' is secured with lenticules extending perpendicularly to the stripes 27. A front cover or flap 36 is mounted for pivotal movement over the window and screen.

To perform the trick, the magician shows the open book to the audience so that the stripes are clearly seen both directly and through the lenticular screen, closes the book (including the front cover) and inserts the pencil through the cut-outs so that opposite ends protrude outside the book. The magician then raises the front cover enabling the audience to look through the lenticular screen, revealing that the stripes 27' are still visible, appearing essentially unchanged, but the cental portion of the pen which extends through the book has disappeared, but both ends of the pen are still visible.

The invention can be embodied in a building fitting in the home or business to conceal objects behind the screen while admitting light therethrough.

As shown in FIG. 11, a hinged door 41 of a kitchen cabinet 42 has a central panel formed by a lenticular screen 2" with parallel vertical lenticules. When closed, wider objects close to the panel will remain visible but slim objects spaced apart from the screen will not be visible. Horizontally extending portions will be accentuated. Long stems of wineglasses, for example, will be invisible when viewed through the door, while the horizontal stripes of shelves 43 will be clearly seen providing an element of surprise when the cabinet door is opened to reveal the presence of wineglasses in what had appeared to be an empty shelf. The effect can be accentuated by providing a horizontally striped lining on the back wall of the cabinet which remains of unchanged appearance when viewed directly, when the door is open or through the screen, when the door is closed.

As shown in FIG. 12, a picture 3' of a standing man 3*a*' on a horizontally striped background 3*b*' forms a rear panel 46 of a generally oval or elliptical band 47 of translucent or clear resiliently flexible plastic material, at least a front panel 48 of which is a lenticular screen with parallel vertical lenticules. When the band is in relaxed state, opposite bowed side portions 49 of the band maintain the front panel 48 extending adjacent and generally parallel to the rear panel 46 (and picture 3') so that an audience can seen both the man and the striped background by looking through the front panel. The magician then squeezes the bowed side portions towards each other (in the direction of the arrows), either rapidly or slowly, causing them to straighten, increasing the separation of the front and rear panels, resulting in the disappearance of the man with the back ground stripes remaining and now covering the area formerly occupied by the man. Releasing the end portions brings the man back into the picture. The change can be made slow so that the man appears to dissolves or so fast that the audience does not notice any progressive transitional blurring of the image of the man prior to disappearance.

A further trick is based on the provision of a lenticular screen in which the density of the lenticules progressively decreases when progressing from one end of the screen to another with planar portions of the screen between adjacent lenticules being of increasing width towards the other end of the screen which is completely planar and clear. As the screen is moved in opposite directions over an elongate article spaced apart thereunder, the article can progressively disappear with a 'melt away' effect when screen portions of more densley spaced lenticules are progressively moved thereover and, progressively start to reappear when screen portions of less densely packed lenticules are progressively moved thereover until completely visible when under the other completely planar and clear end of the screen.

What is claimed is:

1. A method of performing a vanishing trick comprising the steps of:

providing a scene comprising first and second subjects extending in mutually perpendicular directions;

providing a lenticular screen having a series of parallel lenticules;

displaying the scene to an audience;

relatively positioning the lenticular screen and the scene with the lenticular screen extending a predetermined distance spaced apart from and in front of the scene and with the lenticules extending in a same direction as the direction of extension of the first subject; and, displaying the scene through the lenticular screen to an audience so that the first subject is invisible while an image of the second subject seen through the lenticular screen, remains visible.

2. A method of performing a vanishing trick according to claim 1 comprising the step of providing the second subject as a series of one of printed horizontal parallel stripes and solid horizontal parallel bars forming a background for the first subject and providing the first subject as one of an upright living creature and a vertically extending article, either of which is one of printed across the second subject and a solid article positioned adjacent the second subject.

3. A method of performing a vanishing trick according to claim 2 comprising the step of providing said one of printed stripes and solid bars so that when the scene is displayed through the lenticular screen, said one of printed stripes and solid bars appear to extend over aligned locations formerly occupied by portions of the first subject.

4. A method of performing a vanishing trick according to claim 2 comprising the step of providing the first subject in the foreground.

5. A method of performing a vanishing trick according to claim 1 comprising the step of providing the first subject as comprising indicia having a relatively dark color extending over the second subject which has a relatively light color.

6. Apparatus for performing a vanishing trick comprising:

one of a stage, book and box;

a lenticular screen having a series of parallel lenticules extending in a common direction;

means for mounting said lenticular screen across a front of said one of stage, book and box;

a picture marked with first and second subjects having major axes extending in mutually perpendicular directions;

means for positioning said picture extending across a rear of said one of stage, book and box; spaced apart a predetermined distance behind the lenticular screen with the major axis of the first subject extending in a same direction as the extension direction of the lenticules;

whereby, the first subject is invisible to an audience observing the scene through the lenticular screen while the second subject, extending perpendicular to the direction of extension of the lenticules, remains visible to the audience through the lenticular screen.

7. Apparatus according to claim 6, wherein the second subject comprises a series of parallel stripes extending in the common direction and the first subject extends across said stripes.

8. Apparatus according to claim 6, further comprising a cover and removable mounting means for removably mounting the cover in front of the lenticular screen and aligned with a location occupied by the first subject to conceal the location of the first subject from audience view.

9. Apparatus according to claim 8, wherein the cover is one of a door and curtain.

10. Apparatus according to claim 9, further comprising a lamp for mounted on said one of door and curtain when mounted in concealing relation.

11. A method of performing a magic trick comprising the steps of providing a scene comprising first and second subjects extending in mutually perpendicular directions; providing a lenticular screen having a series of parallel lenticules; and, relatively positioning the lenticular screen and the scene with the lenticular screen extending a predetermined distance spaced apart from and in front of the scene and with the lenticules extending in a same direction as the direction of extension of the first subject so that the first subject has a different appearance when viewed both directly and through the lenticular lens and the second subject remains when viewed both directly and through the lenticular lens.

12. A method of performing a magic trick according to claim 11 comprising the step of providing the first subject as comprising one of a solid object and real person.

13. A method of performing a magic trick according to claim 11 comprising the step of providing the second subject as comprising one of a hand and parallel bars.

14. A method of performing a magic trick according to claim 11 comprising the step of providing the second subject as comprising parallel light beams.

15. A method of performing a magic trick according to claim 11 comprising the step of providing the first subject as a knot in a rope and positioning the lenticular screen so that the knot disappears being replaced by an apparently straight rope portion.

16. A method of performing a magic trick comprising the steps of providing an article with a gap therein, portions of the article extending in one direction away from opposite edges of the gap for a distance which is greater than a width of the gap in said direction, providing a lenticular screen having a series of parrallel lenticules; and relative positioning the lenticular screen extending a predetermined distance spaced apart from and in front of the article with lenticules of the screen extending perpendicular to the screen the gap is not visible and the article appears unbroken but otherwise unchanged.

17. A method of performing a vanishing image trick comprising the steps of:

providing a surface with a background formed by printed parallel stripes and with a printed subject image extending perpendicularly across the parallel stripes;

providing a lenticular screen having parallel lenticules;

and positioning the lenticular screen parallel to and at a predetermined distance spaced apart in front of the surface, with the lenticules extending perpendicular to the printed background stripes and in the same direction as the printed subject image;

so that when the surface is viewed through the lenticular screen, the printed subject image vanishes and the printed background stripes remains visible.

18. A method of performing a vanishing image trick according to claim 17 comprising the step of providing the printed background stripes to appear to extend over aligned locations formerly occupied by portions of the printed subject image which crossed the printed background stripes when the printed subject image vanishes.

19. A method of performing a vanishing image trick according to claim 18 comprising the step of providing the printed subject image extending over the printed parallel stripes.

20. A method of performing a vanishing image trick according to claim 19 comprising the step of providing the printed subject image and the printed parallel stripes in a same color.

21. A method of performing a vanishing image trick according to claim 19 comprising the step of providing the printed subject image in a different, more intense color than a color of the printed parallel stripes.

22. A method of performing a vanishing image trick according to claim 19 comprising the step of providing the printed subject image in a different, darker color than a color of the printed parallel stripes.

23. A method of performing a vanishing image trick according to claim 17 comprising the step of positioning the lenticular screen parallel to and at a predetermined distance spaced apart in front of the surface by progressively advancing the lenticular screen in parallel relation across the surface whereby portions of the printed subject image progressively disappear as a result of being covered by the lenticular screen.

24. A method of performing a vanishing image trick according to claim 17 comprising the step of positioning the lenticular screen parallel to and at a predetermined distance spaced apart in front of the surface by progressively increasing separation of the lenticular screen from the background whereby the subject image progressively disappears.

25. A method of performing a magic trick comprising the steps of:

providing a surface with a background formed by printed parallel stripes and with a printed subject image extending perpendicularly across the printed parallel stripes;

providing a lenticular screen having parallel lenticules;

and positioning the lenticular screen parallel and in front of the surface, with the lenticules extending perpendicular to the printed background stripes and in the same direction as the printed subject image and progressively increasing separation of the lenticular screen from the surface whereby the printed subject image progressively disappears and the printed background stripes remains visible.

26. A method of performing a magic trick according to claim 25 comprising the step of providing the background stripes and printed subject image and positioning the lenticular screen so as to cause the printed background stripes to appear to extend over aligned locations formerly occupied by portions of the printed subject image which crossed the printed background stripes, when the printed subject image disappears.

27. Apparatus for performing a vanishing image trick comprising:

a surface with a background image formed by printed parallel stripes and with a subject image extending perpendicularly across the printed parallel stripes;

a lenticular screen having parallel lenticules;

means mounting the lenticular screen parallel and in front of the surface, with the lenticules extending perpendicular to the printed background stripes and in the same direction as the image and for progressively increasing separation of the lenticular screen from the surface whereby the subject image disappears while the background image remains visible.

28. Apparatus according to claim 27 wherein, when the subject image disappears, the printed background stripes appear to extend over aligned locations formerly occupied by portions of the printed subject image which extended across the printed background stripes.

29. Apparatus for performing a vanishing image trick according to claim 28 wherein the surface and the lenticular screen comprise rear and front panels portions, respectively, of an endless resiliently flexible, oval, band of transparent plastic, the mounting means comprising curved end portions of the band whereby the separation of the lenticular screen can be increased by squeezing the end portions together.

30. A method of performing a magic trick comprising the steps of:

providing an electronic display screen with a background formed by parallel stripes and with a subject image extending perpendicularly across the parallel stripes;

providing a lenticular screen having parallel lenticules;

and positioning the lenticular screen parallel and in front of the electronic display screen, with the lenticules extending perpendicular to the background stripes and in the same direction as the image and progressively varying a separation of the lenticular screen from the surface so that when the electronic display screen is viewed through the lenticular screen the subject image progressively one of appears and disappears and the background image remains visible.

31. A method of performing a magic trick according to claim 30 comprising the steps of providing the background stripes and subject image and positioning the lenticular screen so as to cause the printed background stripes to appear to extend over aligned locations formerly occupied by portions of the subject image which crossed the printed background stripes, when the subject image disappears.

32. A method of performing a magic trick according to claim 31 comprising the step of providing a moving subject image.

33. A method of performing a magic trick according to claim 30 comprising the step of progressively increasing the separation of the lenticular screen from the electronic screen so that when the electronic display screen is viewed through the lenticular screen, the subject image progressively disappears.

34. A method of performing an image transformation trick comprising the steps of:

providing a first set and a second set of elongate coplanar subject images with images of the first set intersecting images of the second set; providing a lenticular screen having a series of parallel lenticules; and, relatively rotating the screen and subject image sets in parallel relation at a predetermined spacing apart so that, when viewed through the screen, the first set and the second set of second subject images appear and disappear, alternately.

35. A method of performing an image transformation trick according to claim 34 comprising the the step of providing subject images of the first set and subject images of the second set which are elongate.

36. A method of performing an magic trick according to claim 35 comprising the step of providing the second set of subject images as appearing to extend over aligned locations formerly occupied by portions of the first set of subject images when the first set of subject images disappears and providing the first set of subject images as appearing to extend over aligned locations formerly occupied by portions of the second set of subject images when the second set of subject images disappears.

37. An architectural fitting comprising:

means defining an enclosure with a back wall of parallel stripes and a front wall comprising a lenticular screen having a series of parallel lenticules extending perpendicularly to the background stripes and a predetermined distance in front of the back wall whereby an elongate object placed in the enclosure behind the screen and extending perpendicularly across the parallel stripes is not visible to a person viewing the object through the screen but the image of the background stripes remains visible when viewed through the lenticular screen.

38. An architectural fitting according to claim 37 wherein, when the elongate object is not visible, the parallel stripes appear to extend over aligned locations formerly occupied by portions of the elongate object.

39. An architectural fitting according to claim 38 wherein the enclosure comprises a household cabinet and the lenticular screen comprises a door thereof and the elongate object comprises a household article.

40. A method of performing a stage vanishing trick comprising the steps of:

providing scenery comprising a first subject and a second subject adjacent the first subject, the first subject comprising one of an upright human figure and a vertically extending article and the second subject comprising a series of one of printed horizontal parallel stripes and solid horizontal parallel bars;

providing a lenticular screen having a series of parallel lenticules;

displaying the lenticular screen and the scenery to an audience;

positioning the lenticular screen extending across a front of the stage in view of the audience and with the lenticules extending vertically;

positioning one of a door and curtain in front of only a medial portion of the lenticular screen;

providing a light on said one of a door and curtain;

lowering the scenery at a predetermined spacing behind the lenticular screen in audience view but with the first subject aligned behind said one of door and curtain so as to be hidden from audience view, removing said one of door and curtain and displaying the scenery through the lenticular screen to an audience so that the first subject vanishes while an image of the second subject seen through the lenticular screen remains visible.

41. A method of performing a stage vanishing trick according to claimed 40, comprising the step of providing the scenery so that the image of said series of one of printed horizontal parallel stripes and solid horizontal parallel bars extends over aligned locations formerly occupied by portions of the image of said one of an upright human figure and a vertically extending article which crossed said series of one of printed horizontal parallel stripes and solid horizontal parallel bars, when the first subject vanishes.

* * * * *